US011433980B1

(12) United States Patent
Zarembka et al.

(10) Patent No.: US 11,433,980 B1
(45) Date of Patent: Sep. 6, 2022

(54) APPARATUSES FOR SUPPORTING MARINE DRIVES WITH RESPECT TO MARINE VESSELS

(71) Applicant: Brunswick Corporation, Mettawa, IL (US)

(72) Inventors: Jeffrey A. Zarembka, Plymouth, WI (US); Darin C. Uppgard, Oshkosh, WI (US); Paul A. Ekis, Berlin, WI (US)

(73) Assignee: Brunswick Corporation, Mettawa, IL (US)

( * ) Notice: Subject to any disclaimer, the term of this patent is extended or adjusted under 35 U.S.C. 154(b) by 34 days.

(21) Appl. No.: 17/140,444

(22) Filed: Jan. 4, 2021

(51) Int. Cl.
*B63H 20/02* (2006.01)
*B63H 20/10* (2006.01)

(52) U.S. Cl.
CPC ..... *B63H 20/02* (2013.01); *B63H 20/10* (2013.01); *B63H 2020/025* (2013.01)

(58) Field of Classification Search
CPC ... B63H 20/02; B63H 20/10; B63H 2020/025
See application file for complete search history.

(56) References Cited

U.S. PATENT DOCUMENTS 4,293,080 A * 10/1981 Letica ..... B65D 1/22 220/675
9,376,191 B1 6/2016 Jaszewski
9,701,383 B1 7/2017 Stuber et al.
9,963,213 B1 5/2018 Jaszewski et al.
9,969,475 B1 5/2018 Waisanen
10,464,648 B1 11/2019 Amerling et al.
10,800,502 B1 10/2020 Alby et al.
2011/0140368 A1* 6/2011 Keck ..... F16J 15/3236 277/500
2016/0089962 A1* 3/2016 Kuroki ..... B60J 10/27 49/442

OTHER PUBLICATIONS

Ahlswede et al., unpublished U.S. Appl. No. 16/985,331.
Alby et al., unpublished U.S. Appl. No. 16/043,280.

* cited by examiner

*Primary Examiner* — Stephen P Avila
(74) *Attorney, Agent, or Firm* — Andrus Intellectual Property Law, LLP

(57) ABSTRACT

An apparatus is for supporting a marine drive relative to a marine vessel. The apparatus has a transom bracket for fixed attachment to the marine vessel; a supporting cradle for supporting a powerhead of the marine drive, the supporting cradle being pivotable relative to the transom bracket such that the marine drive is trimmable up and down relative to the marine vessel; and a seal device disposed between the transom bracket and supporting cradle, the seal device blocking sound and water passage through a fore-aft gap between the transom bracket and supporting cradle. The marine drive is trimmable through a range of trim positions including a fully tucked position and a fully trimmed position and the seal device blocks the sound and water ingress throughout the range of trim positions.

25 Claims, 7 Drawing Sheets

APPARATUSES FOR SUPPORTING MARINE DRIVES WITH RESPECT TO MARINE VESSELS

FIELD

The present disclosure relates to marine drives and apparatuses for supporting marine drives with respect to marine vessels.

BACKGROUND

The following U.S. Patents and Patent Applications are incorporated herein by reference:

U.S. Pat. No. 9,701,383 discloses a marine propulsion support system including a transom bracket, a swivel bracket, and a mounting bracket. A drive unit is connected to the mounting bracket by a plurality of vibration isolation mounts, which are configured to absorb loads on the drive unit that do not exceed a mount design threshold. A bump stop located between the swivel bracket and the drive unit limits deflection of the drive unit caused by loads that exceed the threshold. An outboard motor includes a transom bracket, a swivel bracket, a cradle, and a drive unit supported between first and second opposite arms of the cradle. First and second vibration isolation mounts connect the first and second cradle arms to the drive unit, respectively. An upper motion-limiting bump stop is located remotely from the vibration isolation mounts and between the swivel bracket and the drive unit.

U.S. Pat. Nos. 9,969,475 and 9,963,213 disclose a system for mounting an outboard motor propulsion unit to a marine vessel transom including a support cradle having a head section coupled to a transom bracket and a pair of arms extending aftward from the head section and along opposite port and starboard sides of the propulsion unit. A pair of upper mounts is provided, each upper mount in the pair coupling a respective arm to the propulsion unit aft of a center of gravity of an engine system of the propulsion unit. A pair of lower mounts is also provided, each lower mount in the pair coupling the propulsion unit to the transom bracket. The pair of upper mounts is located aft of the pair of lower mounts when the propulsion unit is in a neutral position, in which the propulsion unit is generally vertically upright and not tilted or trimmed with respect to the transom.

U.S. Pat. No. 9,376,191 discloses an outboard motor coupled to a transom of a marine vessel and including a midsection housing having a front side configured to face the transom, a back side opposite the front side, a left side, and an opposite right side. An engine having an engine block is mounted directly to and supported by the midsection housing. A driveshaft is coupled in torque transmitting relation with a crankshaft of the engine, and a portion of the driveshaft is located exterior to the midsection housing. An exhaust pipe that conveys exhaust gas from an exhaust gas outlet of the engine downwardly away from the engine is also located exterior to the midsection housing. In one example, the midsection housing serves as a sump for engine oil.

U.S. Pat. No. 10,464,648 discloses a marine drive having a propulsion unit, a supporting cradle, a resilient mount that couples the propulsion unit to the supporting cradle, a sound blocking member that extends across an internal gap between the propulsion unit and the supporting cradle, and a cowling system having upper and lower cowlings that cover at least a portion of the propulsion unit and lower cradle covers that cover at least a portion of the supporting cradle. The upper and lower cowlings are separated from the lower cradle covers by an external gap so that the upper and lower cowlings can move along with the propulsion unit and with respect to the supporting cradle and the cradle covers. The sound blocking member blocks the sound which otherwise would emanate from propulsion unit via the internal gap and then from the marine drive via the external gap.

U.S. Pat. No. 10,800,502 discloses an outboard motor having a powerhead that causes rotation of a driveshaft, a steering housing located below the powerhead, wherein the driveshaft extends from the powerhead into the steering housing; and a lower gearcase located below the steering housing and supporting a propeller shaft that is coupled to the driveshaft so that rotation of the driveshaft causes rotation of the propeller shaft. The lower gearcase is steerable about a steering axis with respect to the steering housing and powerhead.

U.S. patent application Ser. No. 16/985,331 discloses an apparatus for operably connecting a marine drive to a marine vessel. A transom bracket is configured for fixed attachment to the marine vessel and for attachment to the marine drive such that the marine drive is trimmable up and down with respect to the marine vessel about a trim axis. The transom bracket has a sidewall with a rigging opening through which at least one elongated rigging member extends for operably connecting the marine drive to the marine vessel, wherein the rigging opening is located along the trim axis.

U.S. patent application Ser. No. 16/043,280 discloses an apparatus is for supporting an outboard motor on a transom of a marine vessel. The apparatus has a transom bracket configured for fixed attachment to the transom; a supporting cradle that supports the outboard motor with respect to the transom bracket, wherein the supporting cradle is pivotable with respect to the transom bracket about a trim axis; and a trim actuator that is pivotally coupled to the transom bracket at a first trim actuator pivot axis and to the supporting cradle at a second trim actuator pivot axis. Extension of the trim actuator pivots the supporting cradle upwardly about the trim axis. Retraction of the trim actuator pivots the supporting cradle downwardly about the trim axis. Advantageously, the trim axis is located aftwardly of the first trim actuator pivot axis so that added clearance is provided between the marine vessel and the outboard motor when the outboard motor is trimmed upwardly.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

In examples disclosed herein, an apparatus is for supporting a marine drive relative to a marine vessel. The apparatus has a transom bracket for fixed attachment to the marine vessel; a supporting cradle for supporting a powerhead of the marine drive, the supporting cradle being pivotable relative to the transom bracket such that the marine drive is trimmable up and down relative to the marine vessel; and a seal device disposed between the transom bracket and supporting cradle, the seal device blocking sound and water passage through a fore-aft gap between the transom bracket and supporting cradle. The marine drive is trimmable through a range of trim positions including a fully tucked position and a fully trimmed position and the seal device blocks the sound and water ingress throughout the range of trim positions.

The seal device for sealing between the transom bracket and the supporting cradle comprises an elongated base, a plurality of sealing lips that extend from the elongated base, the plurality of sealing lips including an upper sealing lip, a lower sealing lip and a medial sealing lip located between the upper sealing lip and the lower sealing lip, and a first plurality of ribs extending between the upper sealing lip and the medial sealing lip and a second plurality of ribs extending between the lower sealing lip and the medial sealing lip.

BRIEF DESCRIPTION OF THE DRAWINGS

The present disclosure is described with reference to the following Figures.

DETAILED DESCRIPTION

Figure 1:
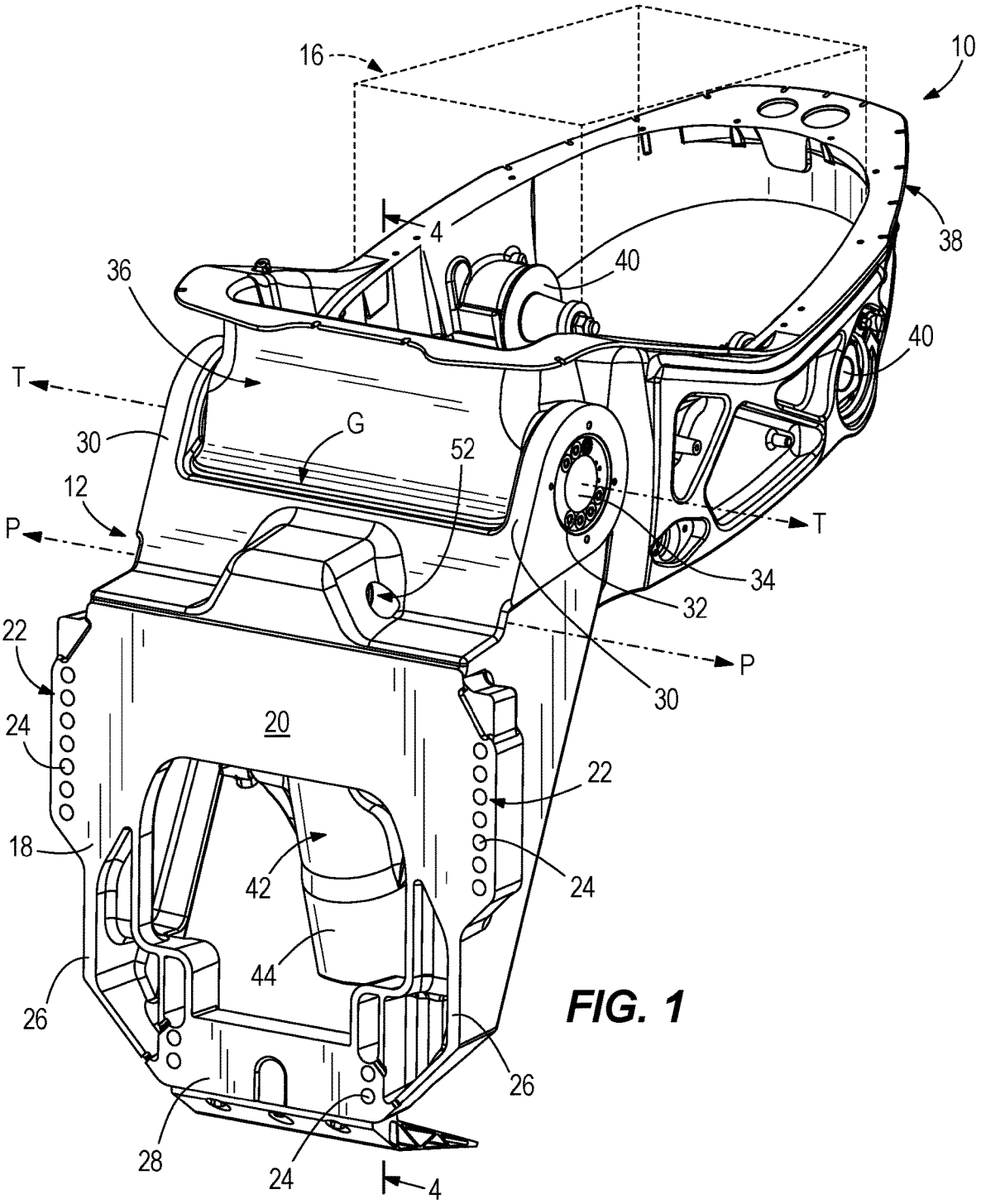
FIG. 1 is a perspective view of an apparatus for supporting a marine drive relative to a marine vessel, the apparatus comprising a transom bracket for fixed attachment to the marine vessel, a supporting cradle for supporting a powerhead of the marine drive, and a trim actuator being extendable and retractable to trim the supporting cradle up and down relative to the transom bracket.
Figure 2:
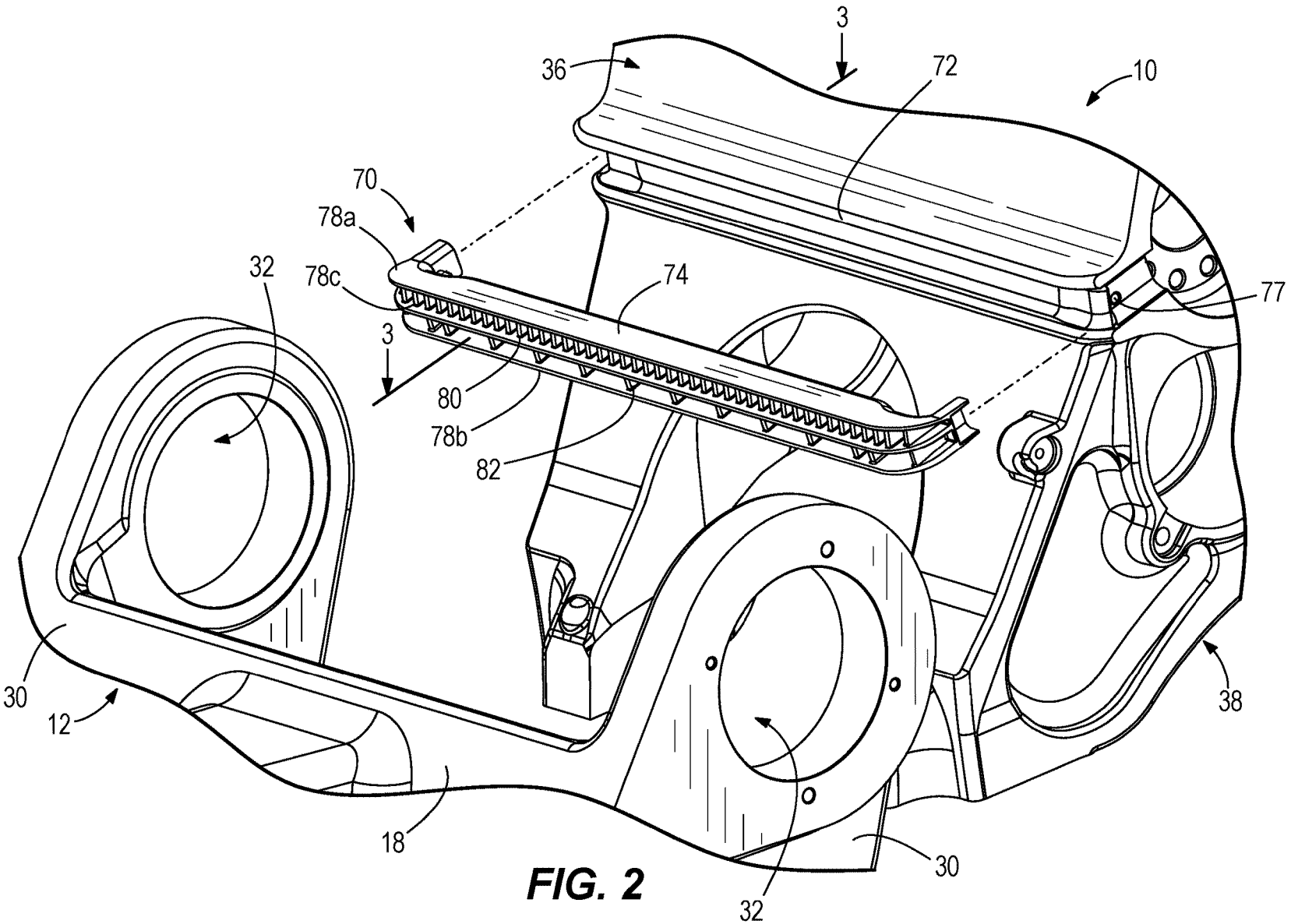
FIG. 2 is a perspective exploded view of the apparatus, showing a seal device for sealing between the transom bracket and the supporting cradle.

FIGS. 1 and 2 depict an apparatus 10 for supporting a marine drive shown relative to a marine vessel. The apparatus 10 includes a transom bracket 12 configured for fixed attachment to the transom of the marine vessel and a supporting cradle 14 configured for supporting a powerhead of the marine drive, shown schematically at 16. The particular configuration of the transom bracket 12 and supporting cradle 14 can vary from what is shown and herein described. The illustrated embodiment includes a marine drive such as disclosed in the above-incorporated U.S. Pat. No. 10,800,502, in particular having a lower gearcase that is steerable about a steering axis with respect to the powerhead 16; however concepts of the present disclosure are not limited for use with such an arrangement.

In the illustrated example, the transom bracket 12 has a base portion 18 with a mounting face 20 that faces the transom. Mounting flanges 22 laterally extend from opposite sides of the base portion 18, each having mounting holes 24 through which fasteners (not shown) extend for fixedly mounting the base portion 18 to the transom. Opposing lower arms 26 of the base portion 18 extend downwardly relative to the mounting face 20 and are connected by a bridge 28. The bridge 28 has mounting holes 24 through which fasteners (not shown) extend for mounting to the base portion 18 to the transom. Opposing mounting arms 30 extend upwardly from the base portion 18 and have mounting holes 32 for retaining port and starboard tilt pins 34. The tilt pins 34 pivotably couple the transom bracket 12 to the supporting cradle 14 along a trim axis T, such that the supporting cradle 14 is pivotable (i.e., trimmable) up and down relative to the transom bracket 12 and associated marine vessel about the trim axis T, for example as disclosed in the above-incorporated U.S. Pat. Nos. 9,969,475; 9,963,213; and 10,464,648. Again, the configuration of the transom bracket 12 can vary from what is shown and described, including according to the other examples disclosed in the above-incorporated U.S. patents and patent applications.

In the illustrated example, the supporting cradle 14 has a mounting head 36 and a cylindrical body 38 that forwardly extends from the mounting head 36. The cylindrical body 38 supports port and starboard resilient mounts 40, which in turn resiliently support the powerhead 16, for example as disclosed in the above-incorporated U.S. Pat. Nos. 9,969,475; 9,963,213; and 10,464,648. The nature and construction of the resilient mounts 40 can be conventional and in accordance with one or more of the presently incorporated patents, and as such are not further herein described. The mounting head 36 of the supporting cradle 14 is located between and is pivotably coupled to the mounting arms 30 of the transom bracket 12.

Figure 4:
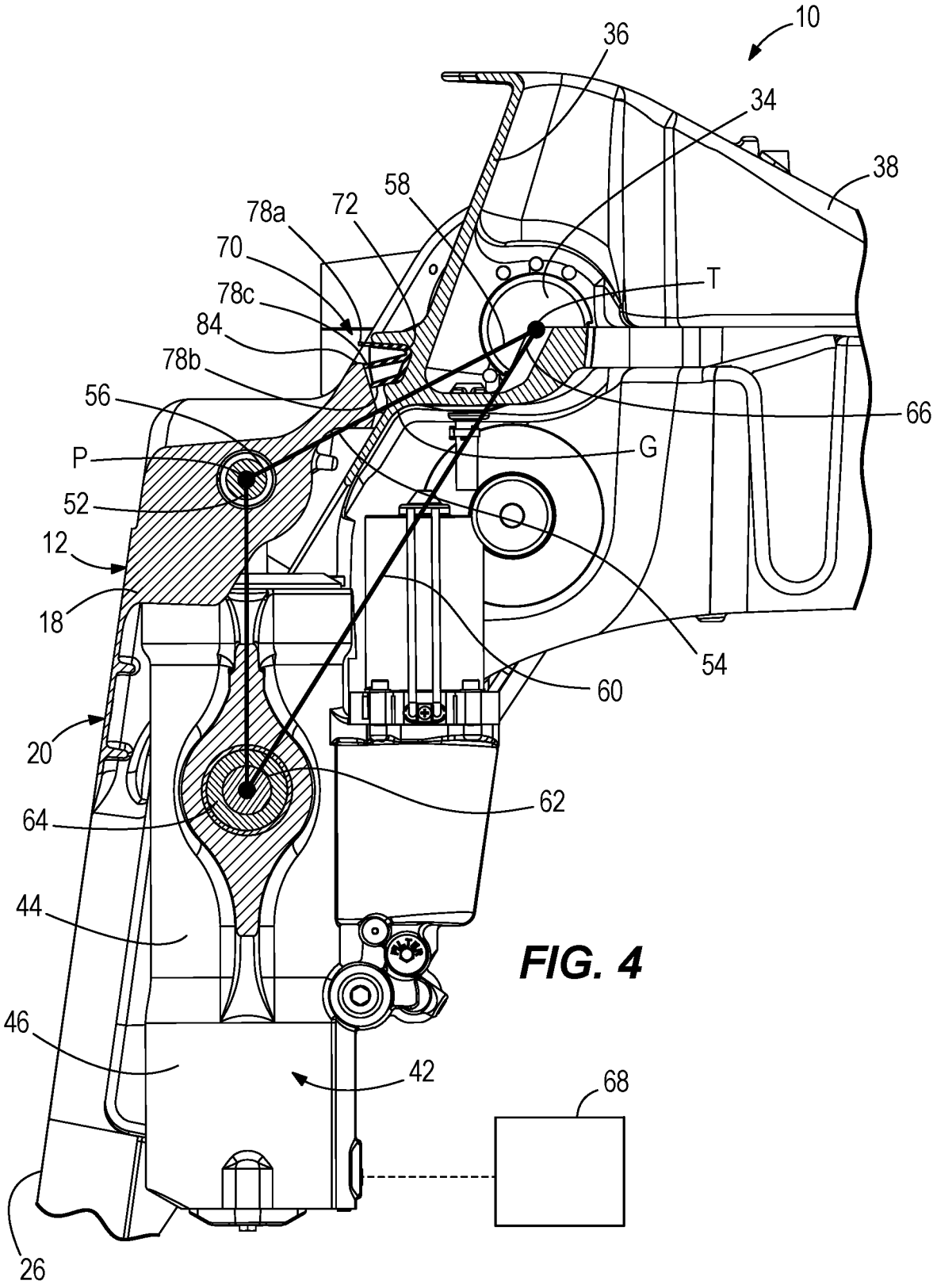
FIG. 4 is a view of section 4-4, taken in FIG. 1, showing the supporting cradle in a fully tucked position.
Figure 5:
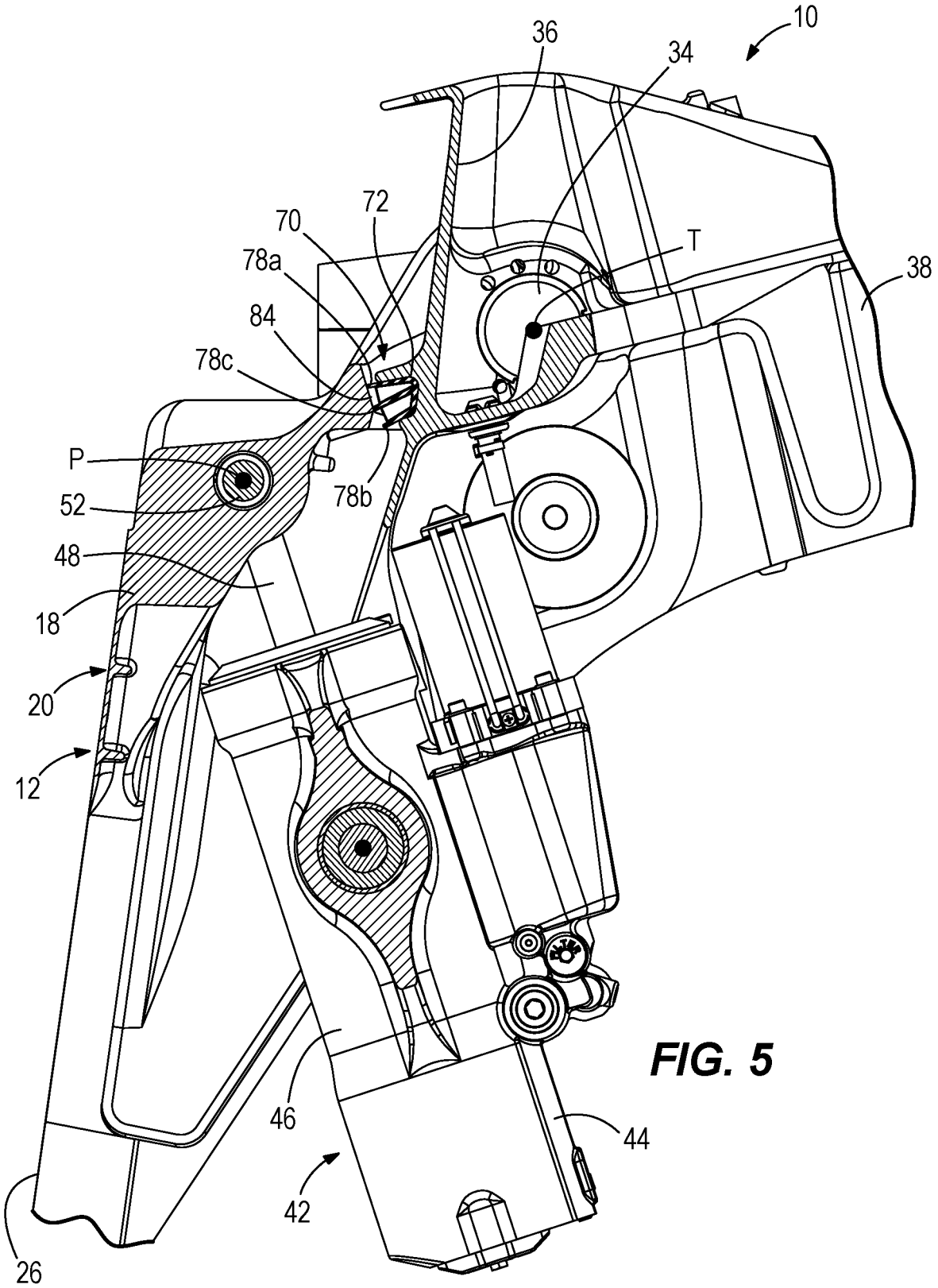
FIG. 5 is a view like FIG. 4, showing the supporting cradle in a partially trimmed position.
Figure 6:
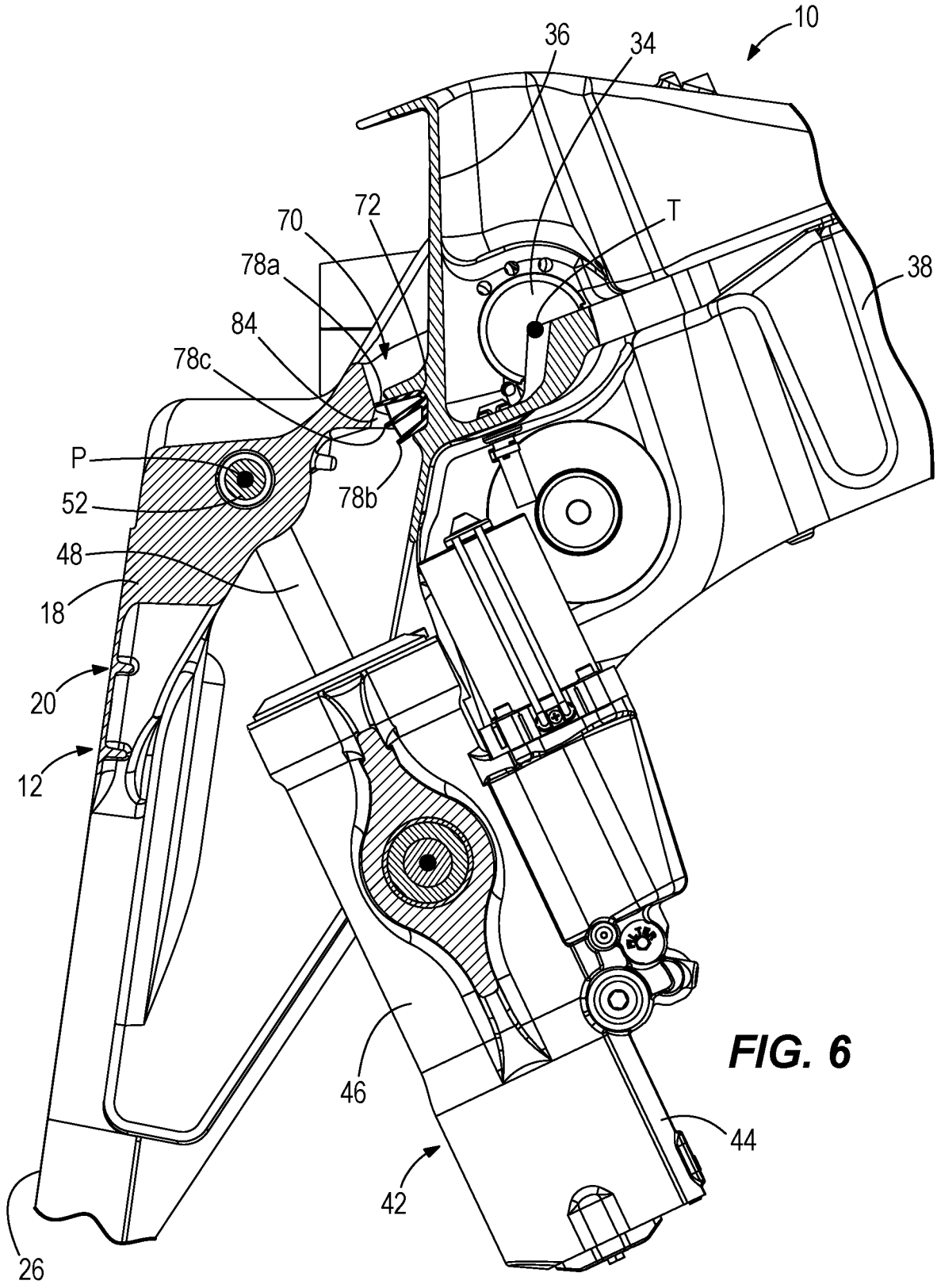
FIG. 6 is a view like FIG. 5, showing the supporting cradle in a fully trimmed position.

Referring to FIG. 4, a trim actuator 42 is configured to cause the supporting cradle 14 to pivot (i.e., trim) up and down about the trim axis T to thereby trim the marine drive 16 up and down about the trim axis T relative to the marine vessel, as is shown and will be described herein below with reference to FIGS. 5-7. The type and configuration of trim actuator 42 can vary from what is shown and described and can for example include an electric actuator, a hydraulic actuator, a combination of electric and hydraulic actuators, and/or any other mechanism for trimming the marine drive 16 up and down about the trim axis T. In the illustrated example, the trim actuator 42 is a hydraulic piston and cylinder device 44 comprising a cylinder 46 containing a piston (not shown) and a rod 48 coupled at its inner end to the piston and extending from the cylinder 46. The outer end of the rod 48 is pivotably coupled to the interior of the base portion 18 of the transom bracket 12 along a laterally-extending pivot pin 52 that defines a pivot axis P. A first rigid link arm (shown schematically at 54) has a first end 56 connected the outer end of the rod 48 at the pivot axis P and a second end 58 pivotably connected to the supporting cradle 14 along the trim axis T. A second rigid link arm (shown schematically at 60) has a first end 62 connected to a mounting boss 64 on the cylinder 46 and a second end 66 pivotably connected to the supporting cradle 14 along the trim axis T. A hydraulic pump and valve device shown schematically at 68 is configured to automatically control a supply of hydraulic fluid to the cylinder 46, to thereby extend and alternately retract the rod 48 relative to the cylinder 46. The type and configuration of the hydraulic pump and valve is conventional, and for example can be purchased from Mercury Marine, part no. 8m0168241. Together the hydraulic piston and cylinder device 44, first rigid link arm 54 and second rigid link arm 60 comprise a linkage configured such that extension of the rod 48 from the cylinder 46 pivots (trims) the supporting cradle 14 up about the trim axis T relative to the transom bracket 12 and retraction of the rod 48 into the cylinder 46 pivots (trims) the supporting cradle 14 down about the trim axis T relative to the transom bracket 12.

During research and development, the present inventors realized a problem with conventional apparatuses for supporting marine drives on marine vessels. Conventional transom bracket and supporting cradles typically have a fore-aft gap between the two components, which disadvantageously enables passage of water and noise between the components. The present inventors realized this is a problem and the present disclosure is a result of the inventors' efforts to ameliorate this problem. In particular, the present inventors realized it would be advantageous to prevent passage of water and noise between the components, thus providing a quieter marine drive without distracting water spray, while maintaining full functionality of the apparatus.

Figure 3:
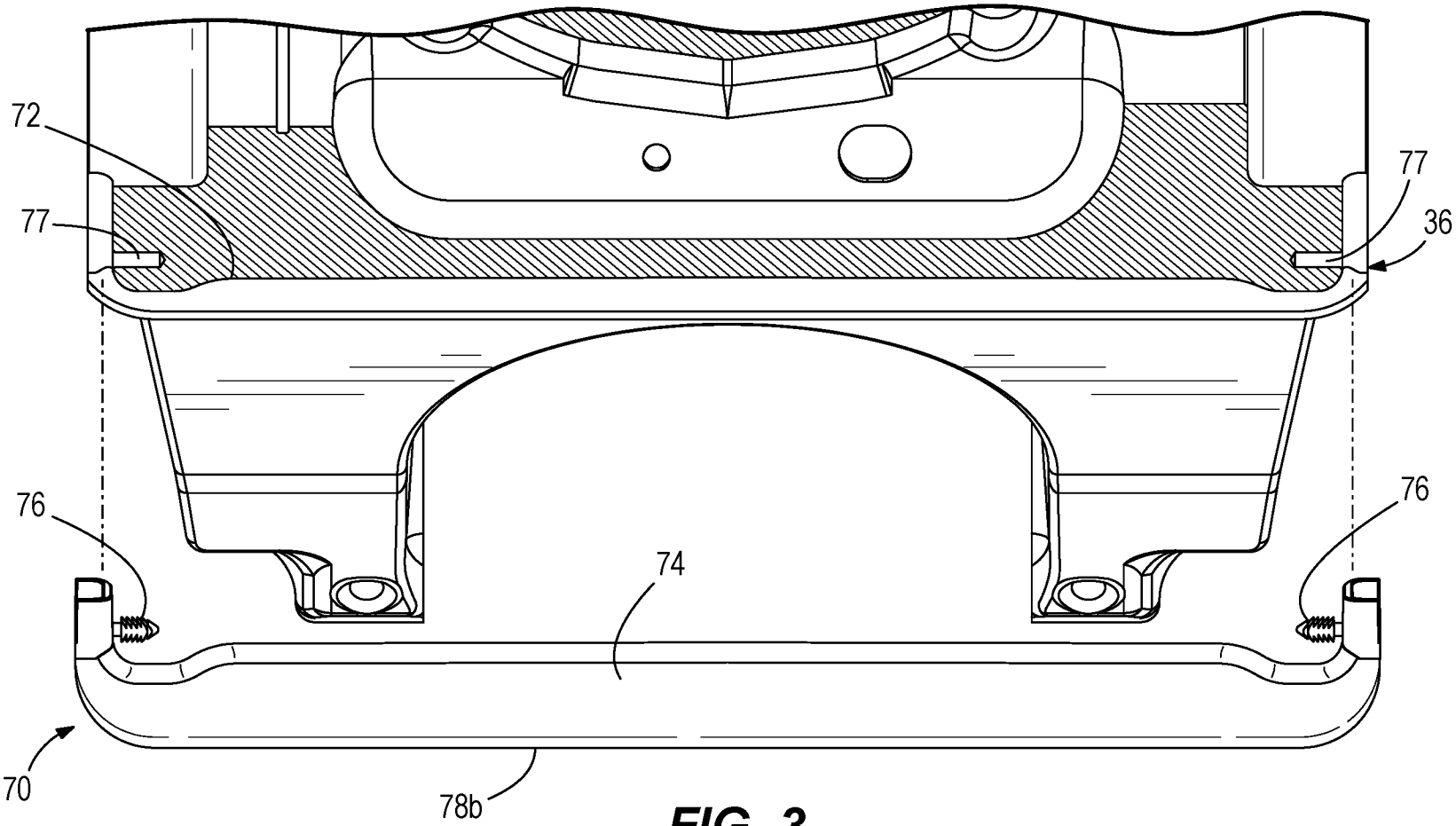
FIG. 3 is view of section 3-3, taken in FIG. 2.

Referring to FIGS. 2-3, a seal device 70 is disposed between the transom bracket 12 and the supporting cradle 14 and is specially configured to block passage of sound and water through the fore-aft gap G (see FIG. 1) between the transom bracket 12 and supporting cradle 14, in particular between the tilt pins 34, throughout a range of trim positions. In the illustrated embodiment, the seal device 70 is affixed to the supporting cradle 14, however in other embodiments the seal device 70 can be affixed to the transom bracket 12. In the illustrated embodiment, the mounting head 36 of the supporting cradle 14 has a channel 72 in which the seal device 70 is mounted. The seal device 70 has an elongated U-shaped base 74 that is affixed to the channel 72 by an adhesive. Opposing port and starboard Christmas tree fasteners 76 located at opposite ends of the U-shape extend into press-fit engagement with holes 77 at the outer ends of the channel 72, on opposite sides of the mounting head 36, and thus further securing the seal device 70 in the channel 72.

Referring to FIG. 2, the seal device 70 has a plurality of sealing lips (78*a*, 78*c*, 78*c*) that extends from the base 74 and axially extend along the trim axis T and spans the entire axial length of the fore-aft gap G. More specifically, the plurality of sealing lips (78*a*, 78*c*, 78*c*) includes an upper sealing lip 78*a*, a lower sealing lip 78*b* and a medial sealing lip 78*c* located between the upper sealing lip 78*a* and the lower sealing lip 78*c*. A first plurality of ribs 80 transversely extends between the upper sealing lip 78*a* and medial sealing lip 78*c*, and a second plurality of ribs 82 transversely extends between the medial sealing lip 78*c* and the lower sealing lip 78*c*. The first plurality of ribs 80 has more ribs than the second plurality of ribs 82, which has less ribs 82 being further spaced apart from each other. The ribs 80, 82 are configured to provide support for the plurality of sealing lips (78*a*, 78*c*, 78*c*), including spacing and resiliency.

Figure 7:
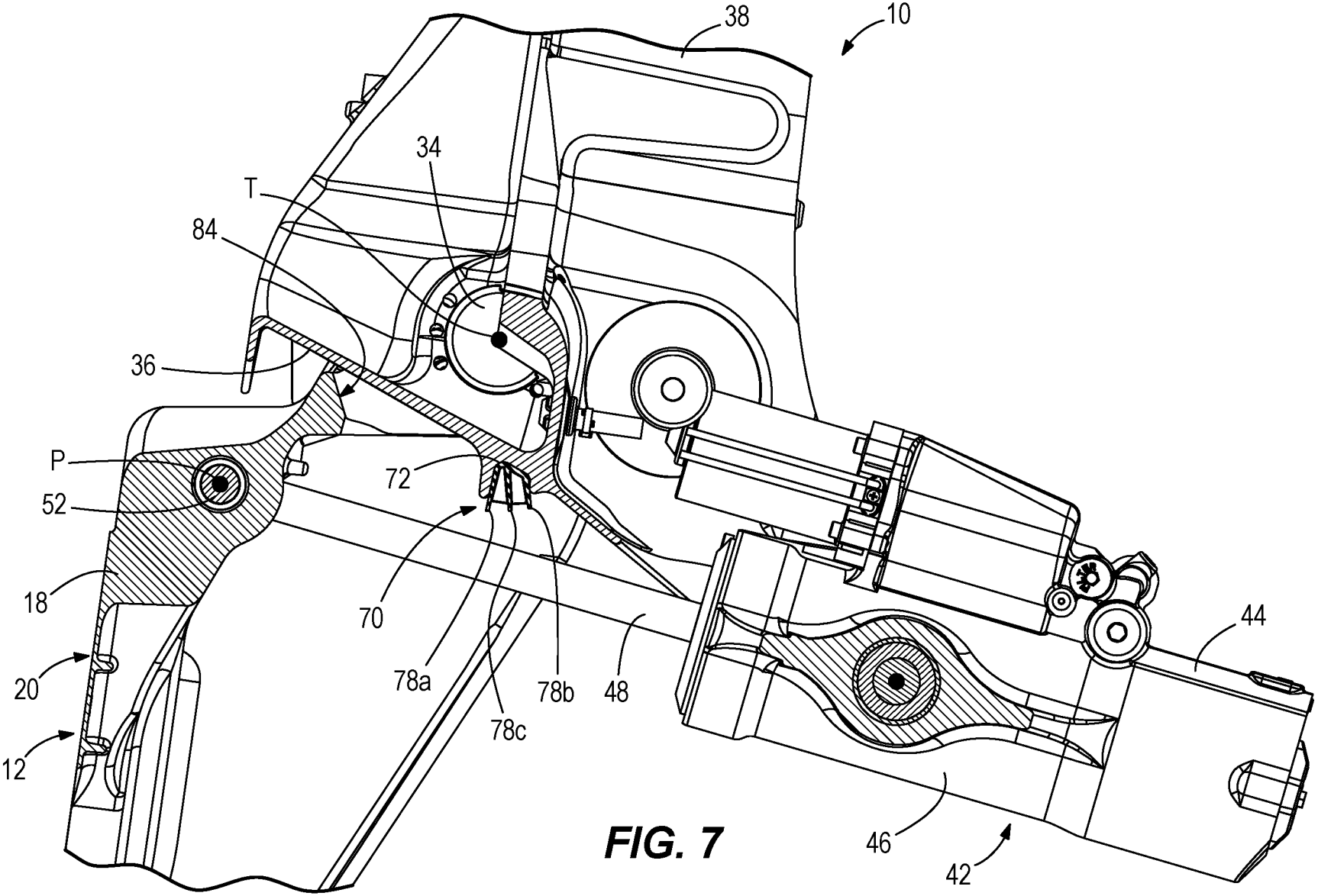
FIG. 7 is a view like FIG. 6, showing the supporting cradle pivoted beyond the fully trimmed position, into an inactive or service position.

Referring to FIGS. 4-7, the marine drive, including the supporting cradle 14 is pivotable (trimmable) into and between a range of trim positions, including a fully tucked position (FIG. 4), partially trimmed position (FIG. 5), a fully trimmed position (FIG. 6), and upwardly beyond the fully trimmed position into an inactive or service position (FIG. 7). The plurality of sealing lips (78*a*, 78*c*, 78*c*) extends out of the channel 72. Each sealing lip 78*a*, 78*b*, 78*c* spans the fore-aft gap G and has an outer end that abuts a sealing surface 84 (see FIG. 7) on the forward side of the top of the transom bracket 12 at various trim positions of the trim actuator 42 and supporting cradle 14, in particular so as to block passage of sound and water through the fore-aft gap G during operation of the marine drive.

Referring to FIG. 4, in the fully tucked position, the lower sealing lip 78*b* and the medial sealing lip 78*c* abut the sealing surface 84 to form a seal there with and block passage of sound and water through the fore-aft gap G. When the hydraulic pump and valve device 68 causes the trim actuator 42 to extend the rod 48 from the cylinder 46 and thus causes the supporting cradle 14 to trim upwardly about the trim axis T into the partially trimmed position shown in FIG. 5, the upper sealing lip 78*a* pivots towards and then into abutment with the sealing surface 84. The lower sealing lip 78*c* slides along and maintains a seal with the sealing surface 84, and then pivots out of sealing abutment with the sealing surface 84. The medial sealing lip 78*c* slides along and remains continuously in sealing abutment with the sealing surface 84. As such, the seal device 70 continuously blocks passage of sound and water throughout this range of trim positions. Referring to FIG. 6, when the hydraulic pump and valve device 68 causes the trim actuator to further extend the rod 48 from the cylinder 46 and thus causes the supporting cradle 14 to trim upwardly about the trim axis T into the fully trimmed position, the upper sealing lip 78*a* slides along and remains in sealing abutment with the sealing surface 84. The medial sealing lip 78*c* slides along and then pivots out of sealing abutment with the sealing surface 84. The lower sealing lip 78*c* pivots further away from the sealing surface 84. As such, the seal device 70 continuously blocks passage of sound and water throughout this range of trim positions. In this way, it will be seen that the sealing location (i.e. the location at which the sealing lips 78*a*, 78*b*, 78*c* engage the sealing surface 84) is moved about the trim axis T as the marine drive is trimmed up and down relative to the marine vessel. However, in any event the plurality of sealing lips 78 continuously abuts and slides along the sealing surface 84 as the supporting cradle 14 is pivoted relative to the transom bracket 12. Referring to FIG. 7, further extension of the rod 48 from the cylinder 46 raises the supporting cradle 14 and marine drive into an inactive or service position. In this position, the seal device 70 is rotated out of engagement with the sealing surface 84, as shown.

It will thus be seen that the present disclosure provides a novel and improved marine drive having a powerhead; a transom bracket for fixed attachment to the marine vessel; a supporting cradle supporting the powerhead, the supporting cradle being pivotable relative to the transom bracket such that the marine drive is trimmable up and down relative to the marine vessel; and a seal device disposed between the transom bracket and supporting cradle, the seal device blocking sound and water ingress via a fore-aft gap between the transom bracket and supporting cradle. The marine drive is trimmable through a range of trim positions including a fully tucked position and a fully trimmed position, and wherein the seal device blocks the sound and water ingress throughout the range of trim positions.

The present disclosure further provides a novel and improved seal device for sealing between a transom bracket and a supporting cradle supporting a powerhead of a marine drive. The seal device has an elongated base, a plurality of sealing lips that extend from the elongate base, the plurality of sealing lips including an upper sealing lip, a lower sealing lip and a medial sealing lip located between the upper sealing lip and the lower sealing lip, and a first plurality of ribs extending between the upper sealing lip and the medial sealing lip and a second plurality of ribs extending between the lower sealing lip and the medial sealing lip.

This written description uses examples to disclose the invention, including the best mode, and also to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. An apparatus for supporting a marine drive relative to a marine vessel, the apparatus comprising:

a transom bracket for fixed attachment to the marine vessel;

a supporting cradle for supporting a powerhead of the marine drive, the supporting cradle being pivotable relative to the transom bracket such that the marine drive is trimmable up and down relative to the marine vessel; and a seal device disposed between the transom bracket and supporting cradle, the seal device blocking passage of sound and water through a fore-aft gap between the transom bracket and the supporting cradle;

wherein the marine drive is trimmable through a range of trim positions including a fully tucked position and a fully trimmed position, and further wherein the seal device blocks the sound and water ingress throughout the range of trim positions.

2. The apparatus according to claim 1, wherein the seal device is affixed to a first one of the transom bracket and the supporting cradle and comprises a sealing lip that abuts a sealing surface of a second one of the transom bracket and the supporting cradle, and wherein the sealing lip continuously sealingly abuts and slides along the sealing surface as the supporting cradle is pivoted relative to the transom bracket.

3. The apparatus according to claim 1, wherein the supporting cradle is pivotable about a trim axis relative to the supporting cradle, wherein the sealing lip sealingly abuts the sealing surface, and wherein the sealing location is moved about the trim axis as the marine drive is trimmed up and down relative to the marine vessel.

4. The apparatus according to claim 1, wherein transom bracket and supporting cradle are coupled together by port and starboard tilt pins and wherein the fore-aft gap is located between the port and starboard tilt pins.

5. The apparatus according to claim 4, wherein the seal device is affixed to a first one of the transom bracket and the supporting cradle and comprises a sealing lip that abuts a sealing surface of a second one of the transom bracket and the supporting cradle, wherein the sealing lip continuously sealingly abuts and slides along the sealing surface as the supporting cradle is pivoted relative to the transom bracket.

6. The apparatus according to claim 5, wherein the supporting cradle is pivotable about a trim axis relative to the supporting cradle, wherein the sealing lip sealingly abuts the sealing surface, and wherein the sealing lip is moved about the trim axis as the marine drive is trimmed up and down relative to the marine vessel.

7. The apparatus according to claim 6, wherein the first one of the transom bracket and the supporting cradle comprises a channel in which the seal device is mounted.

8. The apparatus according to claim 7, further comprising port and starboard fasteners that fasten the seal device in the channel.

9. The apparatus according to claim 7, wherein the seal device comprises an elongated base that is affixed to the channel and wherein the sealing lip is one of a plurality of sealing lips that extend from the base.

10. The apparatus according to claim 9, wherein the plurality of sealing lips axially extends along the trim axis and spans an entire axial length of the fore-aft gap.

11. The apparatus according to claim 9, wherein the plurality of sealing lips comprises an upper sealing lip, a lower sealing lip and a medial sealing lip located between the upper sealing lip and the lower sealing lip.

12. The apparatus according to claim 11, further comprising a first plurality of ribs transversely extending between the upper sealing lip and the medial sealing lip and a second plurality of ribs transversely extending between the lower sealing lip and the medial sealing lip.

13. The apparatus according to claim 12, wherein the first plurality of ribs has more ribs than the second plurality of ribs.

14. The apparatus according to claim 11, wherein at least one lip in the plurality of sealing lips abuts the sealing surface throughout the range of trim positions.

15. The apparatus according to claim 14, wherein the upper sealing lip is separated from the sealing surface when the marine drive is in the fully tucked position and wherein the lower sealing lip is moved out of abutment with the sealing surface when the marine drive is pivoted beyond the fully trimmed position.

16. The apparatus according to claim 7, further comprising a trim actuator coupled to the transom bracket, the trim actuator being extendable and retractable to trim the supporting cradle up and down relative to the transom bracket.

17. The apparatus according to claim 16, further comprising a first rigid link having a first end pivotably coupled to the transom bracket along the trim axis and a second end coupled to the supporting cradle along a pivot axis, and a second rigid link having a first end pivotably coupled to the trim actuator and a second end pivotably coupled to the supporting cradle along the pivot axis.

18. The apparatus according to claim 17, wherein the trim actuator, first rigid link and second rigid link together comprise a linkage that pivots upwardly about the trim axis when the trim actuator is extended and that pivots downwardly about the trim axis when the trim actuator is retracted.

19. A marine drive comprising:

a powerhead;

a transom bracket for fixed attachment to the marine vessel;

a supporting cradle supporting the powerhead, the supporting cradle being pivotable relative to the transom bracket such that the marine drive is trimmable up and down relative to the marine vessel; and a seal device disposed between the transom bracket and supporting cradle, the seal device blocking sound and water ingress via a fore-aft gap between the transom bracket and supporting cradle;

wherein the marine drive is trimmable through a range of trim positions including a fully tucked position and a fully trimmed position, and further wherein the seal device blocks the sound and water ingress throughout the range of trim positions.

20. A seal device for sealing between a transom bracket and a supporting cradle supporting a powerhead of a marine drive, the seal device comprising a plurality of sealing lips that extend from the elongated U-shaped base, the plurality of sealing lips including an upper sealing lip and a lower sealing lip which together define a U-shaped base, and a medial sealing lip located between the upper sealing lip and the lower sealing lip, and a first plurality of ribs transversely extending between the upper sealing lip and the medial sealing lip and a second plurality of ribs transversely extending between the lower sealing lip and the medial sealing lip.

21. An apparatus for supporting a marine drive relative to a marine vessel, the apparatus comprising:

a transom bracket for fixed attachment to the marine vessel;

a supporting cradle for supporting a powerhead of the marine drive, the supporting cradle being pivotable relative to the transom bracket such that the marine drive is trimmable up and down relative to the marine vessel; and a seal device disposed between the transom bracket and supporting cradle, the seal device blocking passage of sound and water through a fore-aft gap between the transom bracket and the supporting cradle, wherein the marine drive is trimmable through a range of trim positions, and further wherein the seal device blocks the sound and water ingress throughout the range of trim positions.

22. The apparatus according to claim 21, wherein the seal device is affixed to a first one of the transom bracket and the supporting cradle and comprises a sealing lip that abuts a sealing surface of a second one of the transom bracket and the supporting cradle, and wherein the sealing lip continuously sealingly abuts and slides along the sealing surface as the supporting cradle is pivoted relative to the transom bracket.

23. The apparatus according to claim 21, wherein the supporting cradle is pivotable about a trim axis relative to the supporting cradle, wherein the sealing lip sealingly abuts the sealing surface, and wherein the sealing location is moved about the trim axis as the marine drive is trimmed up and down relative to the marine vessel.

24. The apparatus according to claim 21, wherein transom bracket and supporting cradle are coupled together by port and starboard tilt pins and wherein the fore-aft gap is located between the port and starboard tilt pins.

25. The apparatus according to claim 24, wherein the seal device is affixed to a first one of the transom bracket and the supporting cradle and comprises a sealing lip that abuts a sealing surface of a second one of the transom bracket and the supporting cradle, wherein the sealing lip continuously sealingly abuts and slides along the sealing surface as the supporting cradle is pivoted relative to the transom bracket.

* * * * *